US011482115B2

(12) United States Patent
Stayton et al.

(10) Patent No.: US 11,482,115 B2
(45) Date of Patent: Oct. 25, 2022

(54) SYSTEMS AND METHODS FOR PROVIDING OPTIMAL SEQUENCING AND SPACING IN AN ENVIRONMENT OF POTENTIAL WAKE VORTICES

(75) Inventors: Gregory T. Stayton, Peoria, AZ (US); Peter J. Bobrowitz, Cave Creek, AZ (US); Charles C. Manberg, Peoria, AZ (US); Richard D. Ridenour, II, Glendale, AZ (US)

(73) Assignee: AVIATION COMMUNIATION & SURVEILLANCE SYSTEMS LLC, Phoenix, AZ (US)

( * ) Notice: Subject to any disclaimer, the term of this patent is extended or adjusted under 35 U.S.C. 154(b) by 6 days.

(21) Appl. No.: 12/775,321

(22) Filed: May 6, 2010

(65) Prior Publication Data

US 2011/0004398 A1 Jan. 6, 2011

Related U.S. Application Data

(60) Provisional application No. 61/176,046, filed on May 6, 2009.

(51) Int. Cl.
*G08G 5/00* (2006.01)

(52) U.S. Cl.
CPC ..... *G08G 5/0013* (2013.01); *G08G 5/0043* (2013.01); *G08G 5/0091* (2013.01)

(58) Field of Classification Search
CPC ... G08G 5/0013; G08G 5/0043; G08G 5/0091
USPC ..... 701/120
See application file for complete search history.

(56) References Cited

U.S. PATENT DOCUMENTS

| | | | | |
|---|---|---|---|---|
| 5,111,400 | A * | 5/1992 | Yoder | 701/3 |
| 5,227,786 | A * | 7/1993 | Hancock | 340/961 |
| 5,574,698 | A | 11/1996 | Raad | |
| 5,657,009 | A * | 8/1997 | Gordon | 340/968 |
| 6,195,609 | B1 | 2/2001 | Pilley et al. | |
| 6,381,541 | B1 | 4/2002 | Sadler | |
| 6,456,944 | B1 | 9/2002 | Burkhardt et al. | |
| 6,694,249 | B1 | 2/2004 | Anderson et al. | |
| 6,751,545 | B2 | 6/2004 | Walter | |
| 6,828,921 | B2 | 12/2004 | Brown et al. | |
| 7,222,017 | B2 | 5/2007 | Clark et al. | |
| 7,414,567 | B2 | 8/2008 | Zhang et al. | |
| 7,471,995 | B1 * | 12/2008 | Robinson | G01C 23/00 340/901 |
| 7,499,795 | B2 | 3/2009 | Fetzmann et al. | |
| 7,567,187 | B2 | 7/2009 | Ramaiah et al. | |
| 7,592,929 | B2 | 9/2009 | Pepitone | |

(Continued)

FOREIGN PATENT DOCUMENTS

WO WO-0071985 A1 * 11/2000 ..... G01C 23/00

OTHER PUBLICATIONS

J. A. Adam, "Air traffic control: satellites and artificial intelligence promise improved safety and efficiency," in IEEE Spectrum, vol. 28 , No. 2, pp. 27-32, Feb. 1991, doi: 10.1109/6.100906 (Year: 1991).*

*Primary Examiner* — Sheetal R Paulson
(74) *Attorney, Agent, or Firm* — Dickinson Wright PLLC

(57) ABSTRACT

A system is delineated comprising a processor, a transceiver coupled to the processor, and memory including instructions for execution by the processor to send with the transceiver meteorological data, 4-D position data, velocity data, and time and configuration data to a provided ATC ground station.

6 Claims, 1 Drawing Sheet

Sequencing and Spacing Wake Vortex System

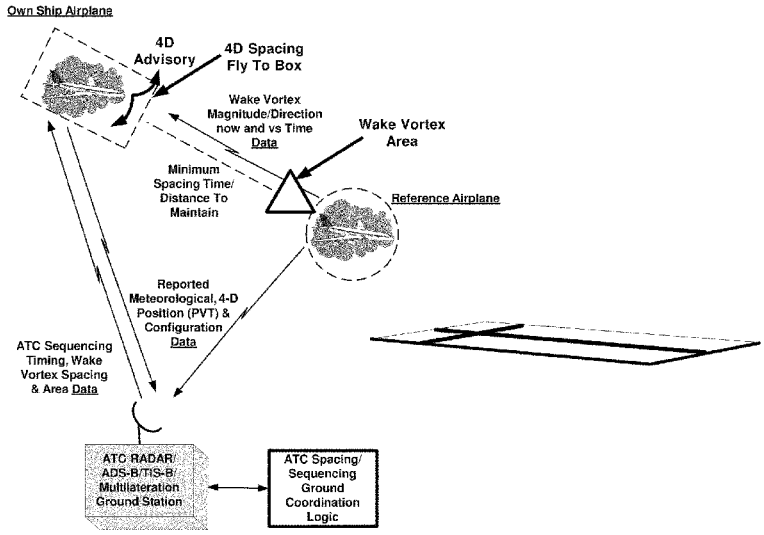

(56) References Cited

U.S. PATENT DOCUMENTS

| | | | | |
|---|---|---|---|---|
| 7,623,960 | B2 | 11/2009 | Wise et al. | |
| 7,630,829 | B2 | 12/2009 | Pepitone | |
| 2002/0042673 | A1* | 4/2002 | Ooga | G01S 7/04 701/120 |
| 2007/0043483 | A1 | 2/2007 | Bagge et al. | |
| 2008/0030375 | A1* | 2/2008 | Cotton | G08G 5/025 701/120 |
| 2008/0035784 | A1* | 2/2008 | Meserole | G08G 5/0008 244/3.1 |
| 2008/0140269 | A1 | 6/2008 | Naimer et al. | |
| 2008/0185301 | A1 | 8/2008 | Merical et al. | |
| 2009/0115637 | A1 | 5/2009 | Naimer et al. | |

* cited by examiner

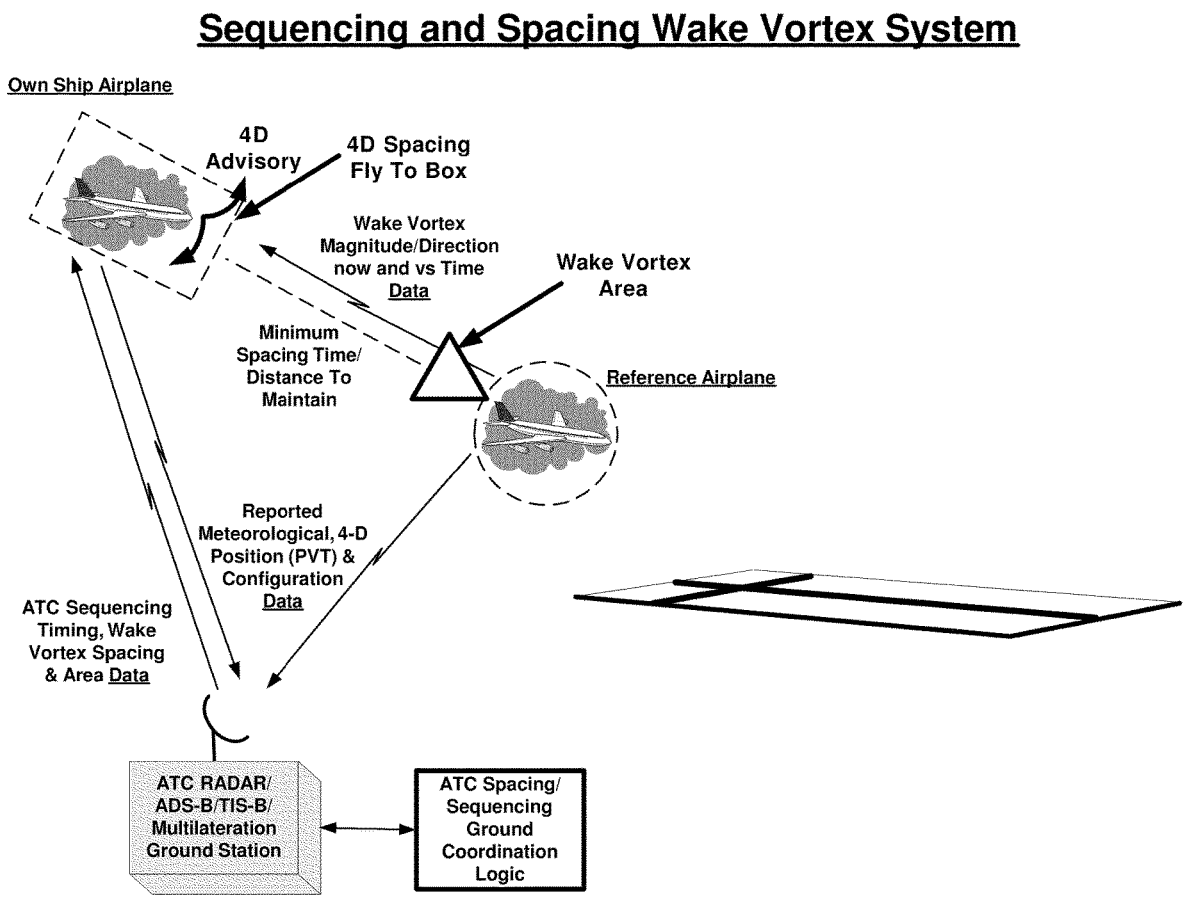
Sequencing and Spacing Wake Vortex System
Own Ship Airplane
4D Advisory
4D Spacing Fly To Box
Wake Vortex Magnitude/Direction now and vs Time Data
Wake Vortex Area
Minimum Spacing Time/ Distance To Maintain
Reference Airplane
Reported Meteorological, 4-D Position (PVT) & Configuration Data
ATC Sequencing Timing, Wake Vortex Spacing & Area Data
ATC RADAR/ ADS-B/TIS-B/ Multilateration Ground Station
ATC Spacing/ Sequencing Ground Coordination Logic

SYSTEMS AND METHODS FOR PROVIDING OPTIMAL SEQUENCING AND SPACING IN AN ENVIRONMENT OF POTENTIAL WAKE VORTICES

CROSS REFERENCE TO RELATED APPLICATIONS

This application is related to and claims priority from U.S. Provisional Patent Application No. 61/176,046, as filed on May 6, 2009 and entitled "SYSTEMS AND METHODS FOR PROVIDING OPTIMAL SEQUENCING AND SPACING IN ENVIRONMENT OF POTENTIAL WAKE VORTICES," which is hereby incorporated by reference.

BACKGROUND OF THE INVENTION

Field of the Invention

The present invention relates to avionics systems, and more particularly, to systems and methods for providing optimal sequencing and spacing in an environment of potential wake vortices.

Description of the Related Art

Weather has a significant effect on air traffic movement from or to an airport. In particular, the potential hazards associated with wake turbulence today prevents airplane optimal separation distances from being used to increase airport traffic throughput. Air Traffic Control (ATC) does not take into account specific airplane dynamics or characteristics in combination with meteorological data to provide optimal traffic spacing. Thus, ATC currently provides larger than necessary fixed distance spacing between airplane types so wake vortex will not cause a hazardous flying condition.

Many new concepts such as the FAA's NextGen and Europe's SESAR using Automatic Dependent Surveillance Broadcast (ADS-B) of more accurate airplane state data (such as position, velocity, intent) to enable significant reductions in the spacing of airport traffic may not be useful unless meteorological and other data can be provided.

Thus, a need exists for improved systems and methods, which overcome these and other problems.

SUMMARY OF THE INVENTION

An embodiment of the present invention discloses a system comprising a processor, a transceiver coupled to the processor, and memory including instructions for execution by the processor to send with the transceiver meteorological data, 4-D position data, velocity data, and time and configuration data to a provided ATC ground station.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

BRIEF DESCRIPTION OF THE DRAWINGS

FIG. 1 is simplified diagram of a sequencing and spacing wake vortex system, in accordance with systems and methods consistent with the present invention.

DESCRIPTION OF THE EMBODIMENTS

Reference will now be made in detail to the present exemplary embodiments of the invention, examples of which are illustrated in the accompanying drawings.

This invention provides wake vortex data elements from the airplane that provides an optimized wake vortex algorithm so that the pilot and ATC can provide for more traffic throughput at the airport while maintaining the necessary safe separation distances or timing between airplane types during various meteorological conditions. This algorithm can be contained within the ground station or within the airplane, or a subset or duplicate of the algorithm can be contained within both the airplane and ground station as necessary to achieve safety and traffic throughput goals.

The "Sequencing and Spacing Wake Vortex System" shown below depicts one possible embodiment of this invention. Own ship and like equipped airplanes send Meteorological, 4-D Position, Velocity, Time and Configuration data to the ATC Ground Station.

This information is then used to determine atmospheric condition effects to the predicted or downlinked wake vortex magnitude.

The ATC Ground Station then computes Wake Vortex magnitude, direction, and time until dissipation of the Wake Vortex to acceptable and safe levels for every airplane sending data. The ATC Ground Station then data links this information up to the own ship airplane along with which airplane ID is to be used as the Reference Airplane for a 4D spacing "Fly To Box" used by the pilot to maintain a safe separation timing or spacing. The Reference airplane can be automatically selected on a display based on the ATC received data, or manually entered by the pilot. The pilot then flies to maintain a safe spacing.

In the event there is a crossing airplane or a sudden change in spacing requirements that cannot be met by the own ship airplane, an encroachment alert may occur with a potential display and/or aural advisory indicating to the pilot the 3-D or 4-D flight path-to-escape from the exposure to the potentially hazardous wake vortex from the reference airplane. If the sudden change is such that a temporary flight path change can permit "wake planning" then the Own ship airplane may be able to later meet the spacing requirements and return to its original flight path.

Linear time modeling of a wake can be done to indicate where in the future a rapid change in safe spacing may occur and the gradient per unit time for a decrease in spacing requirements. For this case the reference airplane would be calculating its maximum anticipated wake turbulence at some time in the future such as after reconfiguration with flaps down for landing where wake turbulence is at it's maximum and data linking this maximum anticipated wake spacing requirement with the gradient decrease in spacing versus time or distance to own ship airplane. Thus the own ship airplane would calculate the closest point of approach during its own landing phase to determine the optimal spacing time or distance. As mentioned earlier (and for other algorithmic calculations as well) this calculation may be done in whole or in part by the ATC ground station, and the information described up-linked to the own ship airplane.

DISPLAY DESCRIPTION

In addition to a display of all airborne traffic, the elements of the own ship airplane display for the Sequencing and Spacing Wake Vortex System may include the following:

Flight director type of display of the speed target to maintain the time or distance spacing for safe flight relative to the wake vortex being created by the reference airplane. This could include a 4_D Spacing Fly To Box or other symbolic means to indicate the 4_D position of where the airplane is to stay safely located to avoid the reference airplanes wake turbulence.

A numeric display of the speed target to maintain the time or distance spacing for safe flight relative to the wake vortex being created by the reference airplane.

A Wake Vortex Footprint displaying a 4-D area on the display for the airplane to avoid. This could include a footprint of relative altitude with textual tag or other 3-D depiction of relative altitude, range, lateral displacement and time or distance from the footprint.

Aural and/or visual alerting of in spacing requirements from the own ship airplane due to a crossing airplane or encroachment on the wake turbulence footprint area of the reference airplane. This alert can be used for wake turbulence planning or wake turbulence avoidance.

A wake turbulence planning or optimized wake turbulence avoidance maneuver advisory for 4-D maneuvering; i.e., slowing down or speeding up, climbing, descending, turning right, or turning left or any combination of the above 4-D maneuvering elements.

Automatic "pop-up" of the reference airplane as determined by the system. This can be determined by ATC ground algorithms and data linked to the airplane or by on-airplane algorithms.

Display decluttering mechanisms to reduce symbols and nomenclature on the display or to reduce the number and/or frequency of aural advisories. This may include but is not limited to display of only wake vortex information on the reference airplane or display only of hazardous wake conditions when beyond a given spacing minimum.

DATA ELEMENTS

Data elements data linked to/from the ground, own ship airplane, or other airplane as needed to achieve safety and traffic throughput goals include but are not limited to the following elements listed below:

Meteorological Sensor Data such as: Barometric pressure, wind speed and direction, temperature, turbulence.

Sequencing spacing/timing data linked from ATC or as calculated by the airplane to initially achieve optimized timing or spacing between own airplane and a reference airplane.

Optimized spacing or timing from own airplane that consider wake turbulence to a reference airplane.

Speed guidance for own airplane that consider wake turbulence relative to a reference airplane.

Maneuver guidance for own airplane including left/right/up/down flight paths that consider wake turbulence relative to a reference airplane.

Dynamic own airplane wake vortex magnitude and direction prediction based on specific airplane parameters, configuration, types, and specific flight characteristics.

Linear time modeled wake vortex magnitude with a scale factor per unit time based on anticipated flight dynamic changes such as airplane configuration changes (changing airplane configuration to landing with flaps at 20 degrees as an example) in "T" minutes from current wake vortex magnitude at time now. May be used during airplane crossings.

Airplane configuration data such as but not limited to airplane type and configuration, gear down, flap angle, angle of attack, airspeed, current weight, max weight to develop a wake factor.

4D position data of each airplane—position, velocity, time to a point in space (PVT).

Other embodiments of the invention will be apparent to those skilled in the art from consideration of the specification and practice of the invention disclosed herein. It is intended that the specification and examples be considered as exemplary only, with a true scope and spirit of the invention being indicated by the following claim.

What is claimed is:

1. A system, comprising:

a processor located in an aircraft;

a transceiver coupled to the processor in the aircraft; and memory in the aircraft including instructions for execution by the processor to send with the transceiver to a provided ATC (Air Traffic Control) ground station including meteorological data, position of an own ship aircraft, velocity of the aircraft, time to a point in space for the aircraft, velocity data for the aircraft, and time and configuration data including:

aircraft type;

aircraft configuration including, gear down status, flap angle status, angle of attack, airspeed, and current weight;

maximum weight to develop a wake factor;

sequencing spacing/timing data linked from ATC or as calculated by the aircraft to initially achieve optimized timing or spacing between own aircraft and reference aircraft;

optimized spacing or timing from own aircraft that consider wake turbulence to a reference aircraft;

speed guidance for own aircraft that considers wake turbulence relative to a reference aircraft;

maneuver guidance for own aircraft including left/right/up/down flight paths that consider wake turbulence relative to a reference aircraft;

dynamic own aircraft wake vortex magnitude and direction prediction based on specific aircraft parameters, configuration, types, and specific flight characteristics;

linear time modeled wake vortex magnitude with a scale factor per unit time based on anticipated flight dynamic changes such as aircraft configuration changes; and the provided ATC (Air Traffic Control) ground station utilizes information sent by the aircraft transceiver to determine one or more of a wake vortex magnitude, a wake vortex direction and a time until dissipation of the wake vortex.

2. The system of claim 1 wherein the system is located in the provided ATC (Air Traffic Control) ground station in communication with the aircraft.

3. The system of claim 1 wherein the system is located both in the provided ATC (Air Traffic Control) ground station and in the aircraft.

4. The system of claim 1 wherein the provided ATC (Air Traffic Control) ground station transmits the determined wake vortex magnitude to an aircraft along with a reference identification for another aircraft associated with the determined wake vortex magnitude.

5. The system of claim 4 wherein information transmitted from the provided ATC (Air Traffic Control) ground station is used by the aircraft to establish a region of separation between the aircraft and the other aircraft.

6. The system of claim 4 wherein the aircraft associated with the determined wake vortex magnitude is automatically displayed on the aircraft as being so associated.

* * * * *